US006880741B2

(12) United States Patent
Gill

(10) Patent No.: US 6,880,741 B2
(45) Date of Patent: Apr. 19, 2005

(54) NAIL GUN ATTACHMENT FOR INSTALLATION OF ROOF SHINGLES

(76) Inventor: Donald C. Gill, 6867 SW. 108th St., Ocala, FL (US) 34476

( * ) Notice: Subject to any disclaimer, the term of this patent is extended or adjusted under 35 U.S.C. 154(b) by 0 days.

(21) Appl. No.: 10/645,523

(22) Filed: Aug. 22, 2003

(65) Prior Publication Data

US 2005/0040207 A1 Feb. 24, 2005

(51) Int. Cl.[7] ..... B25C 7/00

(52) U.S. Cl. ..... 227/154; 227/63; 227/111; 227/151

(58) Field of Search ..... 227/7, 48, 63, 227/111, 151, 154, 156; 29/524; 81/45

(56) References Cited

U.S. PATENT DOCUMENTS 2,326,514 A * 8/1943 Bard ..... 299/37.4
2,915,754 A * 12/1959 Wandel ..... 227/5
4,265,387 A 5/1981 Strouse
4,691,439 A * 9/1987 Marra ..... 30/170
4,821,357 A * 4/1989 Millette ..... 15/93.1
4,858,503 A * 8/1989 Dike, Jr. ..... 81/45
4,928,867 A * 5/1990 Jensen ..... 227/7
5,205,103 A 4/1993 Burton
5,251,371 A * 10/1993 Powers ..... 29/524
5,628,445 A 5/1997 Braddock et al.
D392,170 S 3/1998 Hattori
5,863,100 A * 1/1999 Martin ..... 299/37.1
6,824,036 B1 * 11/2004 Walter ..... 227/120

* cited by examiner

*Primary Examiner*—Louis Huynh
*Assistant Examiner*—Nathaniel Chukwurah
(74) *Attorney, Agent, or Firm*—Richard C. Litman

(57) ABSTRACT

An attachment for a roofing nail gun having a triangular lifting blade having a forward curved "C" shaped lower portion and a flat, vertical upper portion and having mounts on the back in the central portion for attachment to one of several adaptors dimensioned to fit a particular roofing nail gun. The triangular lifting blade may have carbide strips on the front and rear of the lifting blade. The mounts on the lifting blade back have upper and lower aligned mounting bores for attachment to the adaptor and secured to the adaptor by a detent pin. The adaptor has a vertical channel for mounting the lifting blade and an upper horizontal attachment plate having rear grooves for mounting between the cap screws holding the nail driver to the body of the nail gun. The distance between the rear grooves differs on selected adaptors to fit different nail gun models.

16 Claims, 10 Drawing Sheets

NAIL GUN ATTACHMENT FOR INSTALLATION OF ROOF SHINGLES

BACKGROUND OF THE INVENTION

1. Field of the Invention

The present invention relates to nail guns. More particularly, the present invention relates to an attachment for a nail gun which is useful in the installation of roof shingles, particularly for the replacement or securing of a roof shingle partially covered by another shingle.

2. Description of the Related Art

During the installation of shingles on a roof, a run of shingles is made from the base to the top of the roof by nailing at a selected location between the roof side edges. The run has staggered, overlapping left and right shingles such that an upper right hand shingle overlaps the right upper quarter of the next lower left hand shingle, i.e., overlaps half the width and half the height of the left shingle. This procedure is alternated and repeated until a run 1½ shingles wide is completed. Additional lines of shingles are added on each side of the run until the roof is covered. During addition of a left line, starting at the base of the roof and moving upward, a new shingle is inserted adjacent and even with the a right hand shingle and underneath the lower left corner of the next left shingle in the first run, this process being continued to the roof top. This practice is repeated on the left and right of the run of shingles until the roof is covered.

Present practice requires that the lower corner of a left hand shingle be lifted by hand to insert a new shingle to meet the right hand shingle and for nailing in place. This is laborious, and the shingle may be fragile and easily broken or damaged requiring the use of both hands to place the shingle for nailing. The shingles are generally abrasive, requiring the use of gloves which wear quickly and make the lifting process more difficult.

The use of pneumatic nail guns is widespread in the construction and roofing industries. When a roofer uses both hands to insert a shingle in place for nailing, he must put down his nail gun, risking the gun sliding down the sloped roof, and then pick up the gun and position it for nailing, requiring time consuming motion.

It would be desirable to provide an attachment to the roofing nail gun which would allow the corner of the adjacent shingle to be raised and the new shingle slid underneath and nailed in place in a continuous motion, the roofer using one hand to place the new shingle in place and the other hand to lift up the corner of the adjacent shingle and nail the new shingle in place.

U.S. Des. Pat. No. 392,170, issued Mar. 17, 1998, to Hattori, illustrates a pneumatic nailing machine which is of the type useful with the present invention. U.S. Pat. No. 4,265,387, issued May 5, 1981, to Strouse, describes an apparatus for installing shingles on a roof enabling the roofer to stand while installing the shingles. U.S. Pat. No. 5,251,371, issued Oct. 12, 1993, to Powers, describes an attachment for a pneumatic nailer which has a forwardly protruding, spoon-like member for lifting an adjacent portion of a "T"-lock shingle to aid in placement of a new shingle while applying such shingles to a roof.

U.S. Pat. No. 5,205,103, issued Apr. 27, 1993, to Burton, describes a shingle laying apparatus to assist in nailing shingles horizontally along a roof. U.S. Pat. No. 5,628,445, issued May 13, 1997, to Braddock et al., describes a shingle gauge attachment for a roofing type pneumatic nail-driving tool.

None of the above inventions and patents, taken either singly or in combination, is seen to describe the instant invention as claimed. Thus a nail gun attachment for installation of roof shingles solving the aforementioned problems is desired.

SUMMARY OF THE INVENTION

The nail gun attachment for installation of roof shingles of the present invention is a generally triangular lifting blade having a forward extending, curved, "C" shaped lower portion and a flat, vertical upper portion and having mounts on the back in the central portion for attachment to one of several adaptors dimensioned to fit a particular roofing nail gun. The triangular lifting blade is relatively wide at the top and narrows as it curves downward to a horizontal tip, which is rounded and beveled at the tip end.

The triangular lifting blade may have carbide strips on the front and rear of the lifting blade to reduce wear of the lifting blade. The mounts on the back of the lifting blade have upper and lower aligned mounting bores for attachment to the adaptor at a selected upper or lower position, and is secured to the adaptor by a nut and bolt or a detent pin with pull ring as desired, the detent pin being preferred. The upper and lower mounting bores allow the lifting blade to be positioned at one of two selected heights relative to the nail gun as desired by the user.

The adaptor has an upper flat attachment plate having rear grooves for mounting on the nail driver attachment plate, which attaches the nail driver portion of the pneumatic nail gun to the gun body. This is done by loosening the two front nail driver attachment plate cap screws, sliding the adaptor attachment plate into position between the caps of the loosened screws and the nail driver attachment plate by means of the rear grooves, and tightening the cap screws, thereby securing the adaptor attachment plate to the nail gun.

The adaptor has a channel extending downward from the front of the attachment plate which contain the two spaced sets of mounting bores for mounting the curved lifting blade. The adaptor has a central cutout portion between the rear grooves to provide clearance in mounting the adaptor onto the nail gun. The distance between the rear grooves differs on selected adaptors to fit different nail gun models.

Accordingly, it is a principal object of the invention to provide an attachment for a roof nail gun which allows lifting of a portion of an adjacent roofing shingle to allow nailing of another shingle under that shingle portion to a roof being shingled.

It is another object of the invention to provide a roof nail gun attachment for lifting adjacent shingles which is mounted on an adaptor, the adaptor being selected to fit one of a variety of nail guns useful with the present invention.

It is a further object of the invention to provide a roof nail gun attachment formed as a blade having curved lower portion with a horizontal, beveled point for entry under the shingle to be lifted and an upper vertical portion for directing the shingle away from the user.

Still another object of the invention is to provide a roof nail gun attachment for lifting adjacent shingles having rear mounts with at least two sets of mounting bores and a securing pin for mounting the attachment at a selected level relative to the nail gun.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an attachment for roofing nail guns. The attachment is a curved lifting blade having a vertical upper portion and a rear mount for mounting to an adaptor which attaches to a nail gun. The lifting blade is curved downward and forward relative to the nail gun in a partial "C" configuration, and narrows from a relatively wide vertical top to a horizontal, beveled, rounded tip. The attachment allows a roofer to slide the lifting blade under a corner of a roofing shingle and lift it upward by pushing forward on the nail gun, resulting in the edge of the shingle being forced to slide upward along the curved lifting blade and upward so as to protect the user from contact with the lifted shingle. Once the nail gun is in the correct position, another shingle can be placed underneath and nailed in place, providing the desired shingle overlap for roofing. A selection of adaptors is provided for a single curved lifting blade to fit various models and makes of nail gun.

Figure 1:
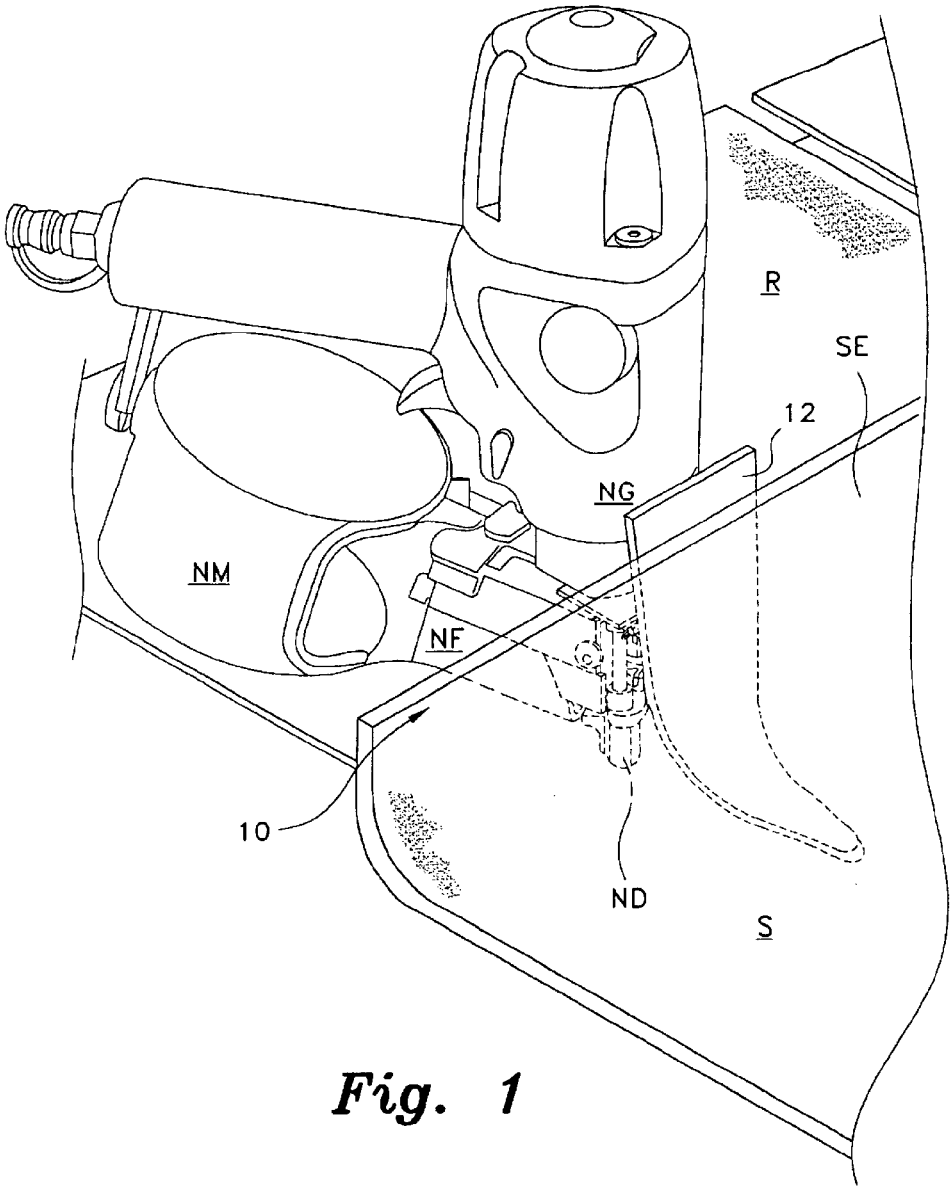
FIG. 1 is an environmental, perspective view of a nail gun attachment for installation of roof shingles according to the present invention.

Referring to the Figures, as seen in FIG. 1 pneumatic shingle lifting and nailing system 10 has a lifting blade 12 in the form of a tapered, generally triangular curved lifting blade attached to the front of nail driver ND of roofing nail gun NG in front of the nail feed mechanism NF which receives nails from nail magazine NM. The lifting blade 12 lifts the corner of shingle S from roof R by forcing the shingle edge SE up along the front face of lifting blade 12 to allow the driving of a nail into a shingle under the lifted corner of shingle S.

Figure 2:
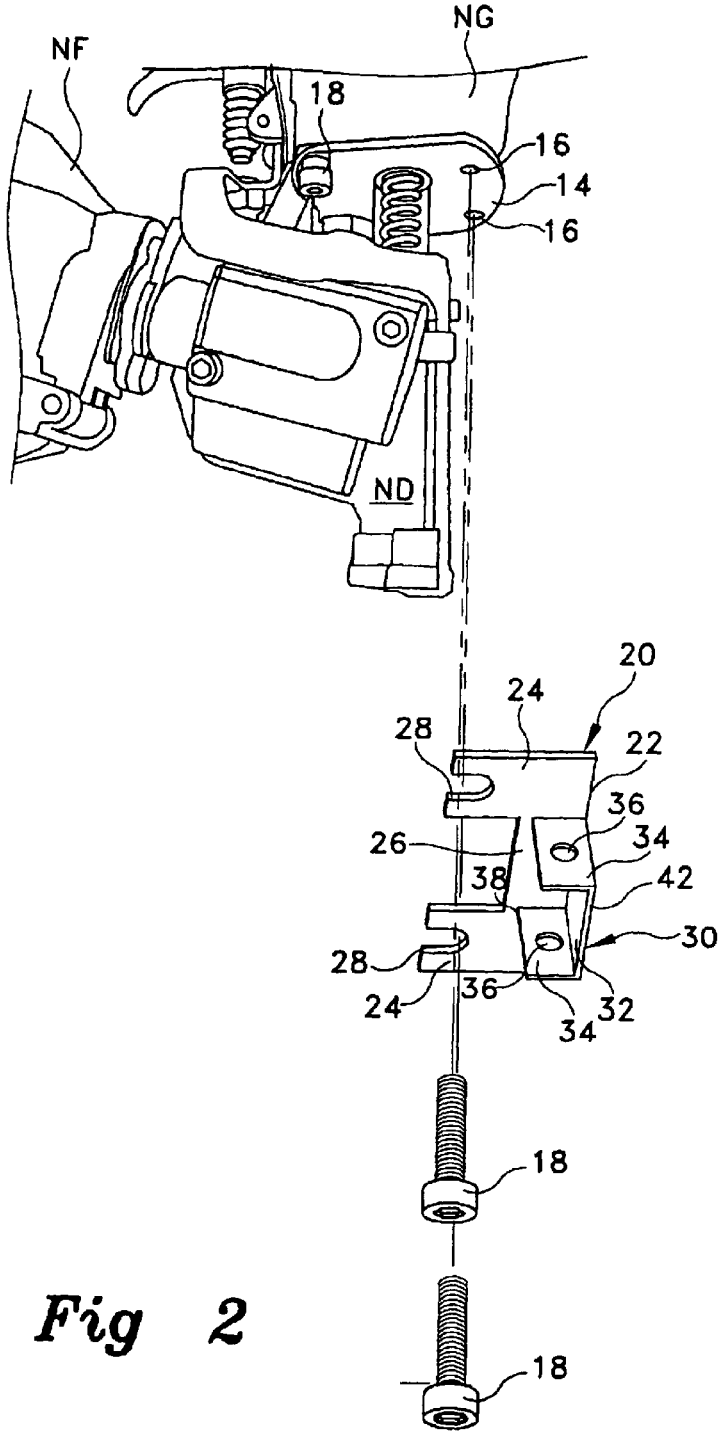
FIG. 2 is an exploded view of the attachment adaptor and nail driver mounting screws of the present invention.
Figure 3:
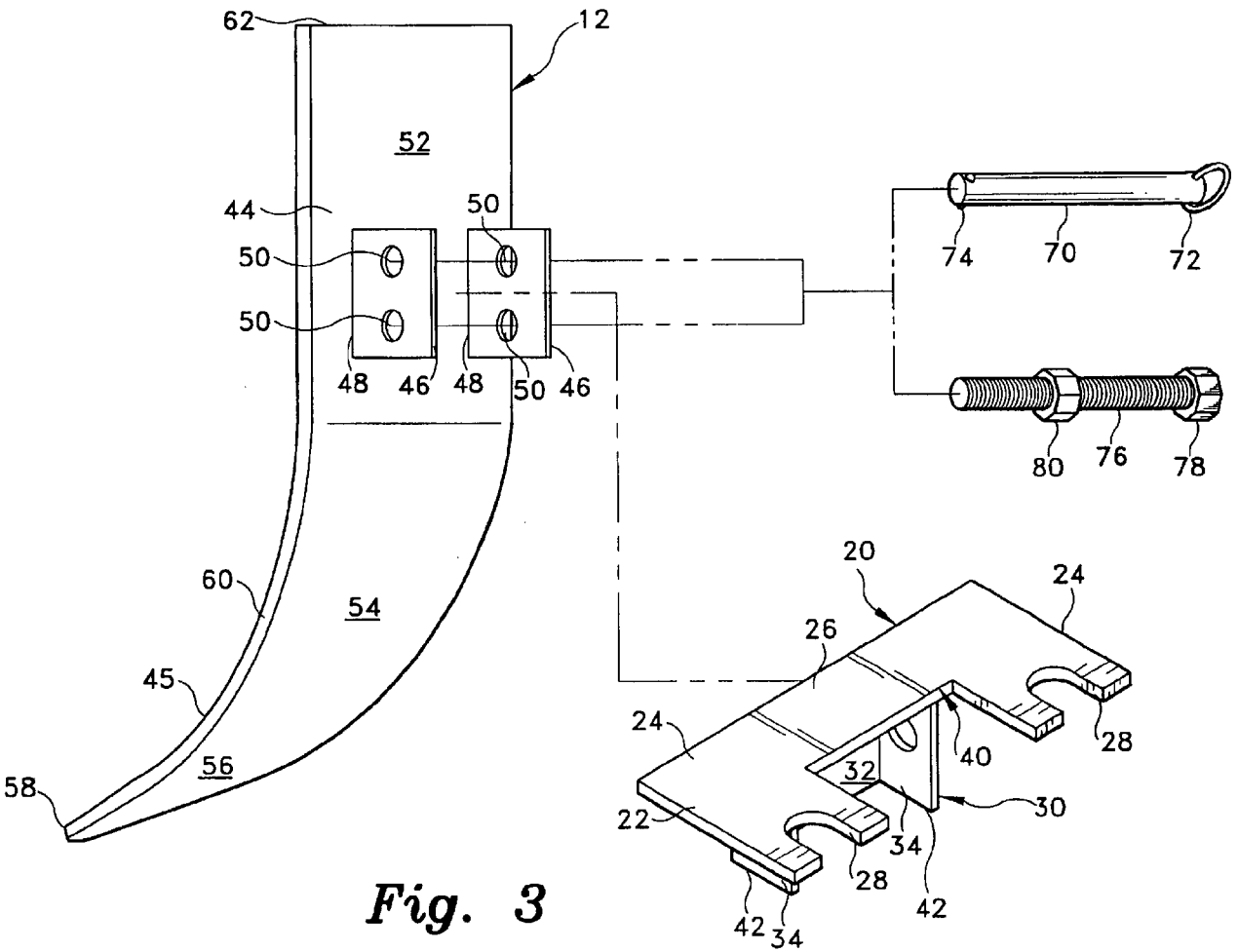
FIG. 3 is an exploded rear view of the lifting blade with adaptor and fasteners of the present invention.
Figure 4A:
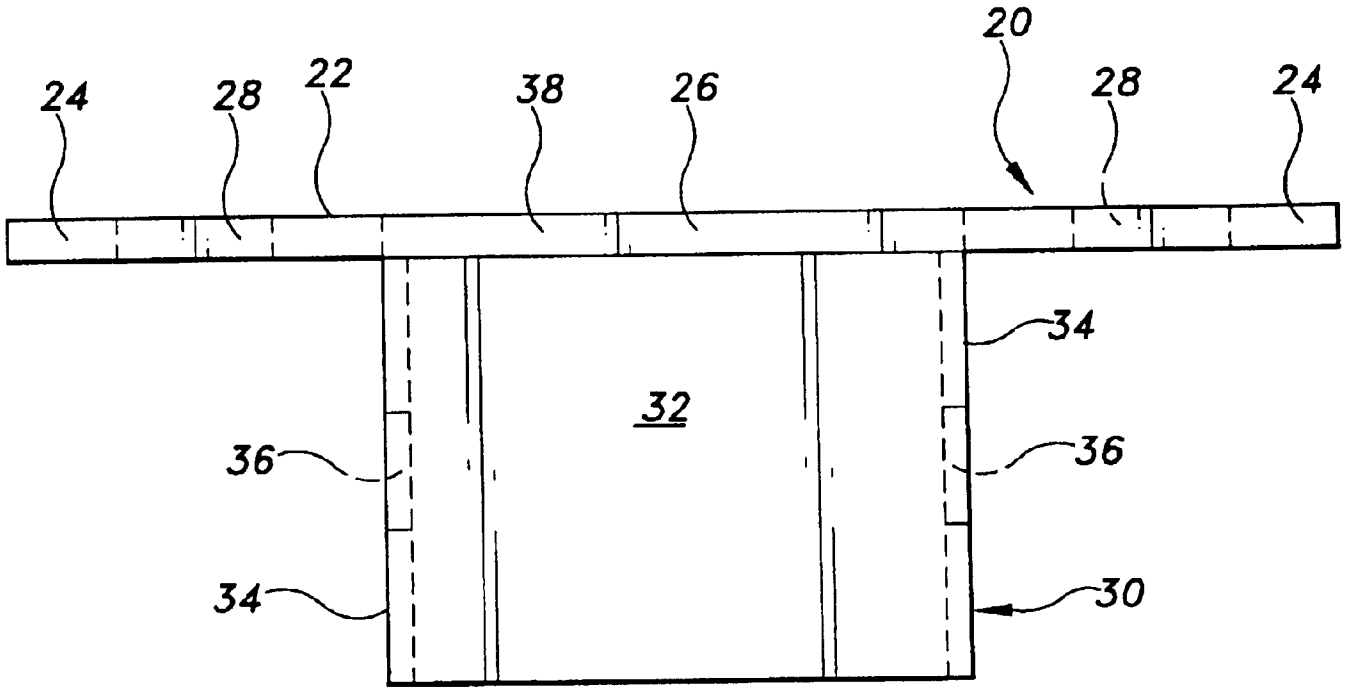
FIG. 4A is a front elevation view of the adaptor of FIG. 1.
Figure 4B:
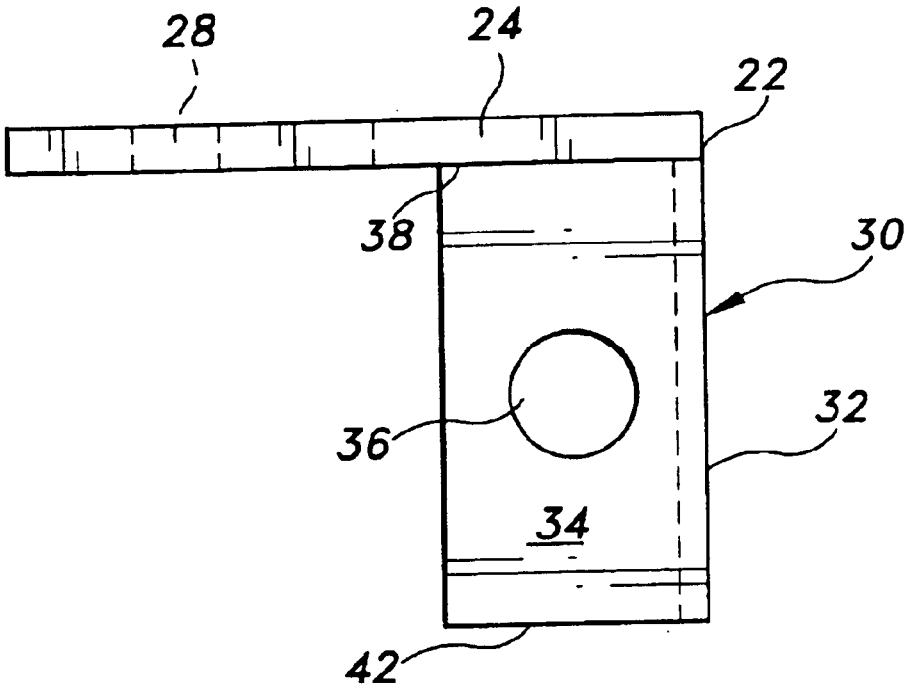
FIG. 4B is a side elevation view of the adaptor of FIG. 1.
Figure 4C:
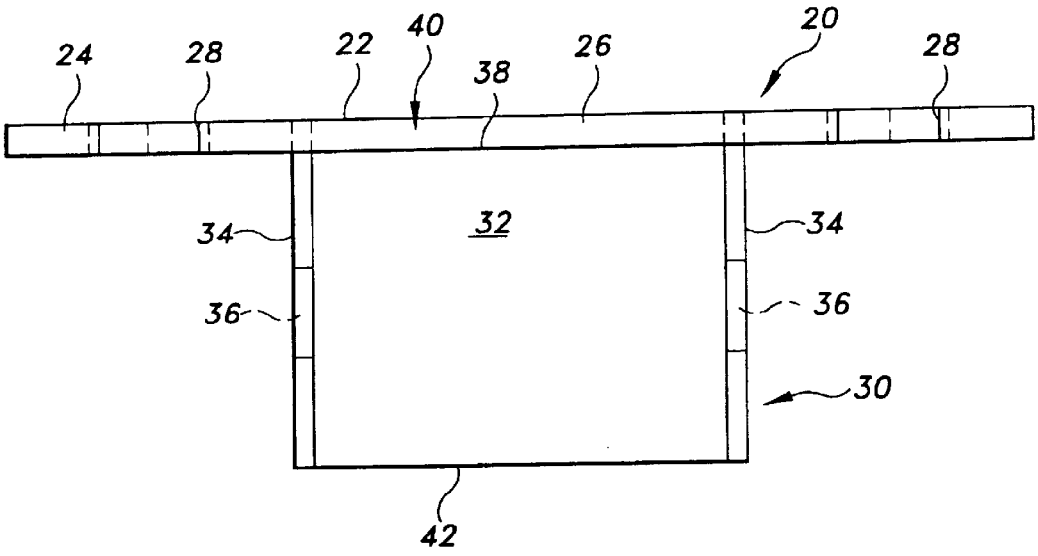
FIG. 4C is a rear elevation view of the adaptor of FIG. 1.
Figure 4D:
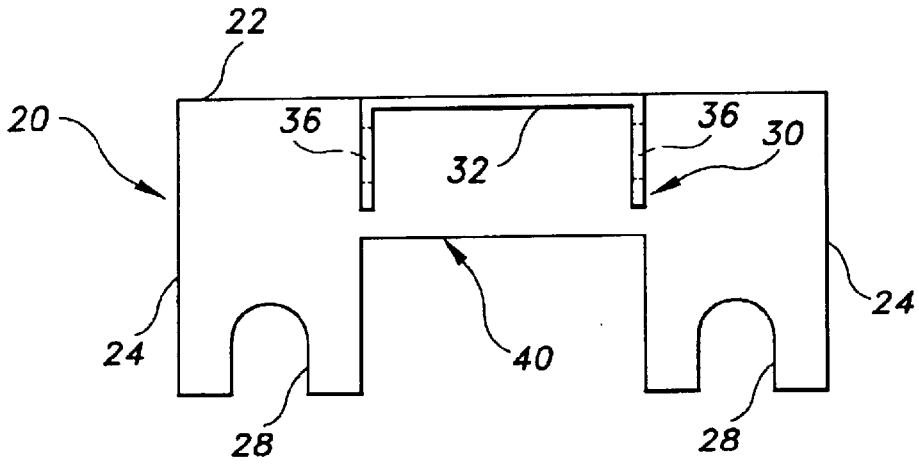
FIG. 4D is a bottom view of the adaptor of FIG. 1.

As seen in FIGS. 2 and 3, the nail driver ND has an upper attachment plate 14 having cap screw receiving bores 16 for securing the attachment plate to the body of the nail gun NG.

As seen in FIGS. 2–4D, the mounting adaptor 20 has a horizontal attachment plate 22 having a front portion and a rear portion and forming the top thereof having groove-containing spaced end portions 24 extending rearwardly therefrom and a front center portion 26 which, along with the spaced end portions 24 form a rear cutout 40 providing clearance for mounting over the nail driver ND portion of the nail gun NG. Spaced end portions 24 each have a rearwardly opening cap screw receiving groove 28. A mounting channel 30 extends downward from the center portion 26 of adaptor mounting plate 22, mounting channel 30 facing forward and having a front wall 32 and opposed side walls 34. Aligned connection bores 36 are located in sidewalls 34 of mounting channel 30. Mounting channel 30 is connected to the underside of bracket attachment plate 22 at channel attachment 38 and ends at bottom edge 42.

Lifting blade 12 has a curved rear surface 44 and a corresponding front surface 45, rear surface 44 having perpendicular flats forming two laterally spaced brackets 46 extending rearwardly from bracket connections 48. Brackets 46 have respective vertically spaced aligned connector bores therethrough, brackets 46 being spaced so as to fit over adaptor mounting channel 30. Lifting blade 12 may be mounted over mounting channel 30 by aligning a pair of aligned bracket connector bores 50 with channel bores 36 of adaptor 20 and inserting a detent pin 70 therethrough until spring detent 74 snaps out on the outside of bracket 48, the ring 72 and detent 74 retaining the pin 70 in place. As an alternative, bolt 76 may be substituted for pin 70 and nut 80 tightened until nut 80 and bolt head 78 engage the outer sides of brackets 46, respectively.

Figure 5A:
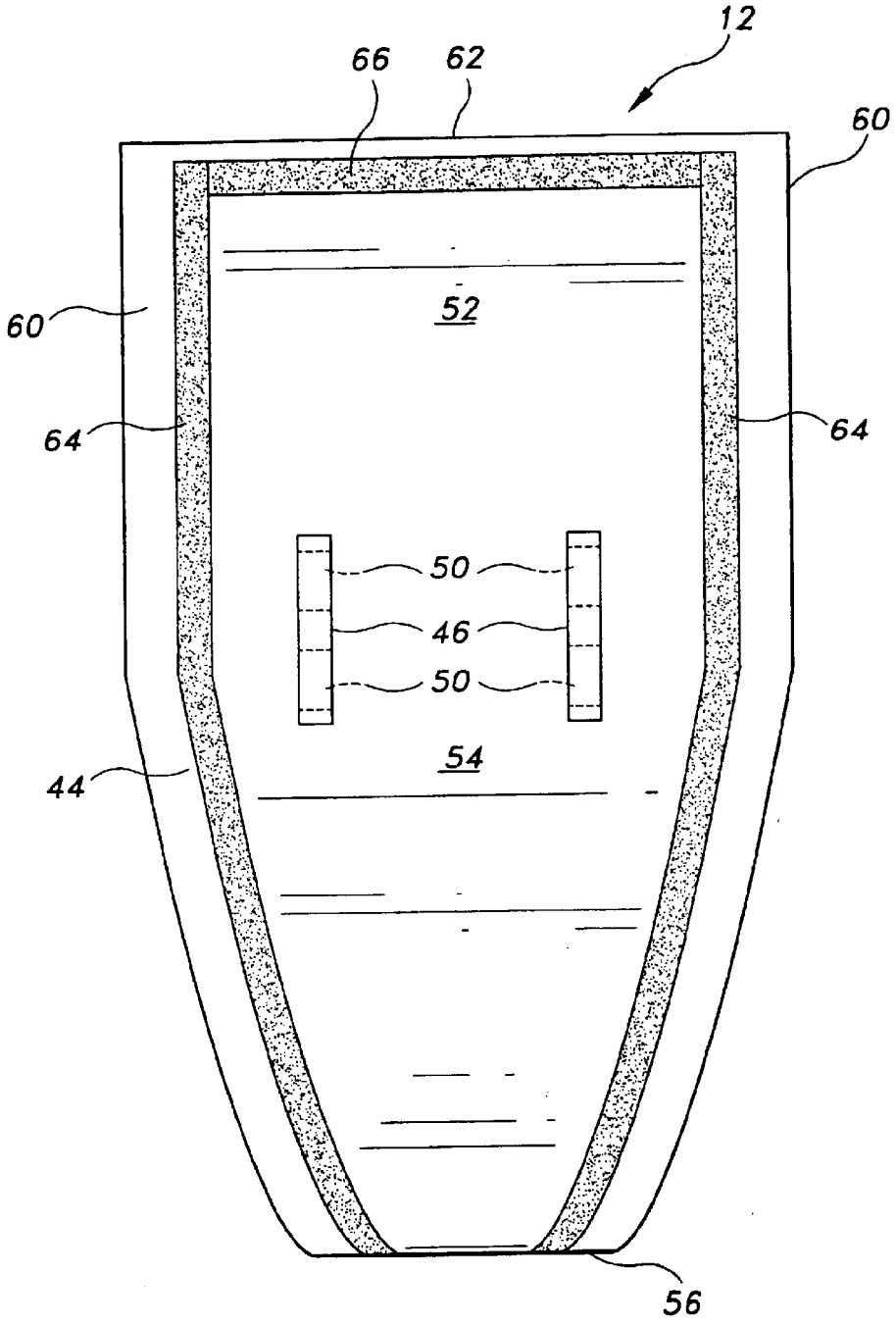
FIG. 5A is a rear elevation view of the lifting blade of the present invention with carbide strips.
Figure 5B:
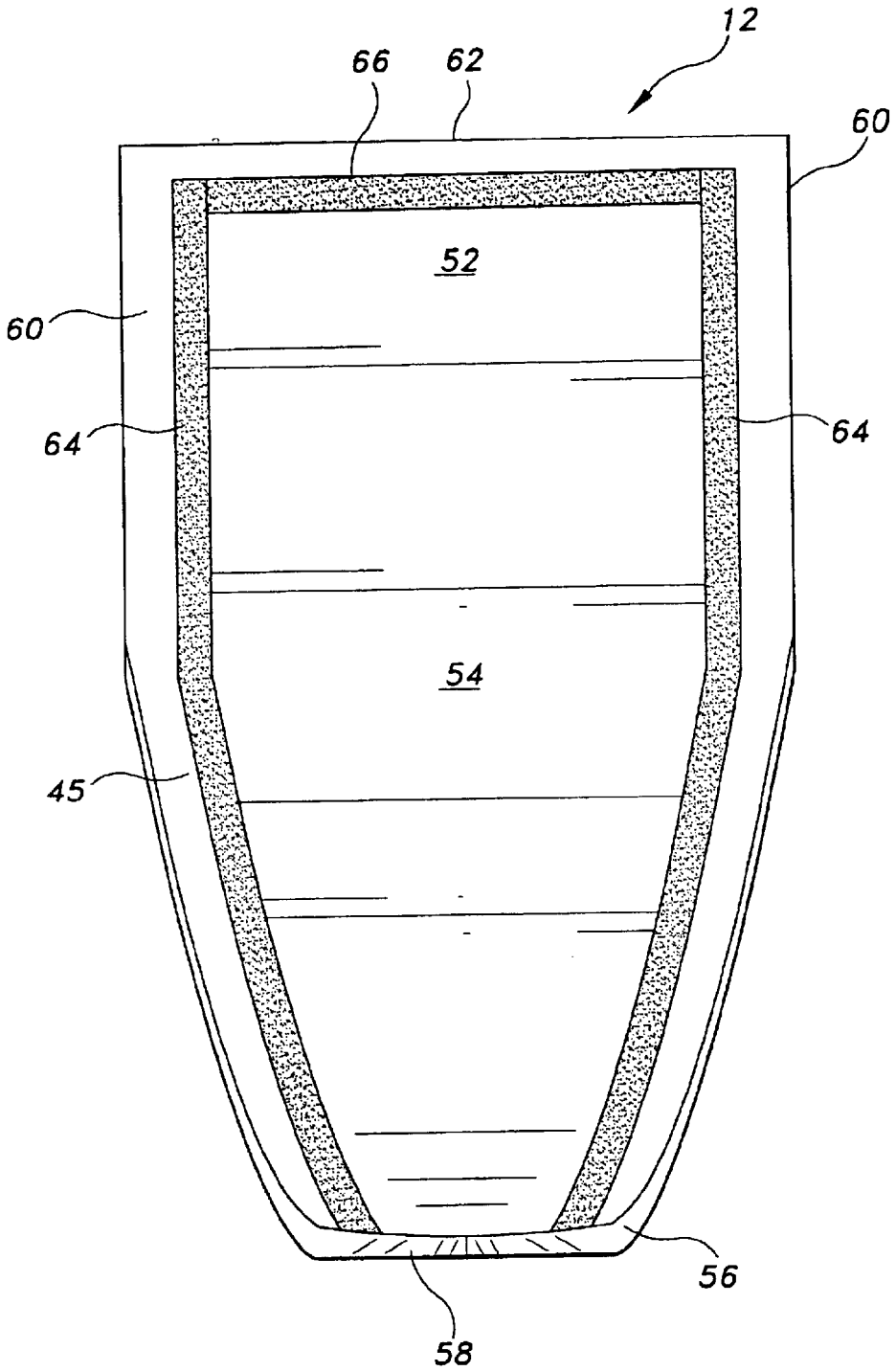
FIG. 5B is a front elevation view of the lifting blade of the present invention with carbide strips.
Figure 5C:
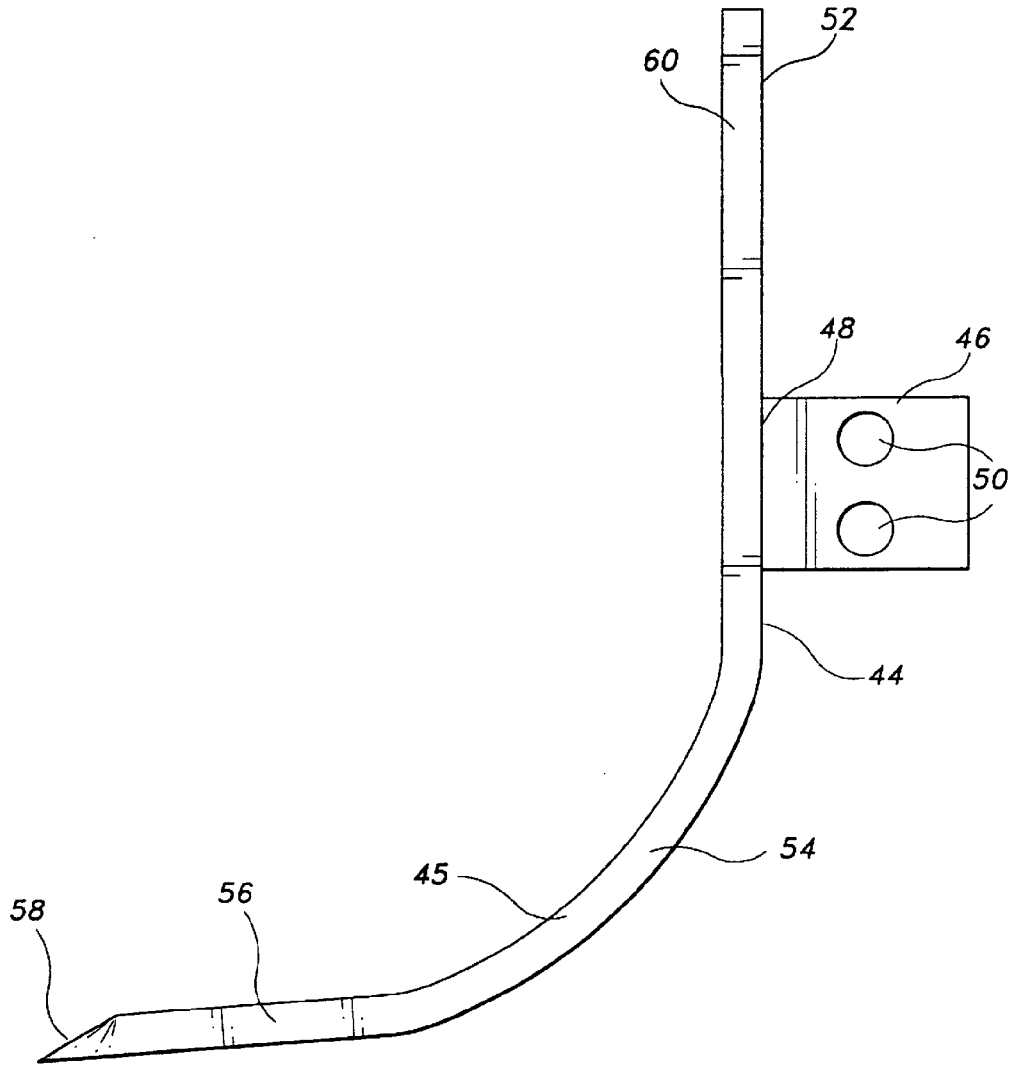
FIG. 5C is a side elevation view of the lifting blade of the present invention.

As seen in FIGS. 5A and 5B, lifting blade 12 has a horizontal upper edge 62, and side edges 60 which taper to a chisel-type, beveled end point 58. The lifting blade has a front surface 45 and a rear surface 44 and includes a generally straight upper portion 52, a curved central portion 54, and lower portion 56 ending in beveled end point 58. Carbide strips 64 may be mounted on lifting blade 12 spaced inward from blade outer edges 60 on each side of blade 12 as desired to extend the life of the lifting blade 12, which is exposed to abrasive roofing surfaces during use. Carbide strips 64 may have a connecting cross strip 66 spaced from the upper edge 62 of the lifting blade 12.

The adaptor attachment plate 22 of adaptor 20 may be differently configured for attachment to different commercially available roofing nail guns. In particular, the following table shows the distance between centers of the cap screw receiving grooves 28 of the adapter 20 for a given nail gun:

TABLE NO. 1

Adaptor Size for Nail Gun Manufacturer

| Manufacturer's Model Number | Nail Gun Manufacturer | Adaptor Size Groove to Groove |
|---|---|---|
| NV 45 AB | Hitachi | 1⅞" |
| CN 450 R | Blue Max | 1⅞" |
| RN 45 B | Bostich | 2" |
| 18455 | Craftsman | 1½" |
| RN 175 | Porter Cable | 1½" |

The lifting blade is preferably about 7½ inches in length, 2¾ inches in maximum width, and has a rounded point of ⅜ inch. The preferred width of the mounting brackets are ¾ inch in width and one inch in length, having horizontally centered ¼ inch vertically spaced holes, the top edges of the brackets being about two inches below the upper edge of the lifting blade. The lower portion of the lifting blade curves forward from the center portion about 2¾inches, and is about 1/16 inch in thickness (shown thicker for illustration purposes).

The adaptor horizontal attachment plate 22 is preferably about 2½ inches wide, but may vary for a particular size of nail gun and the adaptor horizontal plate 22 is about 1¼ inch in depth. The adaptor depending channel 30 is preferably about one inch in vertical length, having a one inch wide front wall 32 and ¾ inch side walls 34, the side walls 34 having a centrally disposed ¼ inch aligned bore 36 through each wall 34. The rear cutout 40 in the adaptor horizontal attachment plate 22 is about one inch in width and ½ inch in depth. The grooves 28 for mounting on the nail gun are preferably about ⅝ inch in length and ¼ in width, however these dimensions may vary for different nail gun models. The detent and ring pin 70 is ¼ inch in diameter and about 1¾ inches in length. The substitute bolt 76 is ¼ inch by 1 and ¾ inch.

The attachment 10 of the present invention is preferably made of steel, but any suitable material may be used in the construction of its various parts.

It is to be understood that the present invention is not limited to the embodiments described above, but encompasses any and all embodiments within the scope of the following claims.

I claim:

1. A nail gun attachment for installation of roof shingles, comprising:

a lifting blade having a front surface and a corresponding rear surface defining a planar top portion, a center portion and a curved lower portion extending downward from and forward of the center portion, the curved lower portion including side edges that taper to form a beveled front end;

a pair of vertically oriented brackets attached to the rear surface of said lifting blade at the center portion, said brackets defining a first pair of horizontally aligned bores;

an adaptor having attachment plate for removable attachment to a nail gun and a pair of side walls perpendicularly extending from the attachment plate and defining a second pair of horizontally aligned bores; and means for securing said brackets to said adaptor;

whereby, when said adapter is secured to said brackets and the nail gun, and upon insertion of the curved lower portion of said lifting blade beneath and adjacent installed shingle and pushing forward on the nail gun, the installed shingles is lifted such that an uninstalled shingle may be placed under the adjacent shingle and nailed in place by the operation of the nail gun.

2. The nail gun attachment of claim 1, wherein said means for securing said rear mounted brackets to said adaptor is selected from the group consisting of a spring detent pin and a bolt and nut, extending through the aligned bores in said brackets and the aligned bores of said adaptor.

3. The nail attachment of claim 2, wherein said brackets defines a third pair of horizontally aligned bores for adjusting the height of said lifting blade when attached to the nail gun.

4. The nail gun attachment of claim 3, wherein said attachment plate defines two cap screw receiving grooves for securing said adapter to the nail gun.

5. The nail gun attachment of claim 4, wherein said attachment plate has a central portion and opposite end portions, said central portion defining a cutout.

6. The nail gun attachment of claim 5, wherein said grooves are defined within said opposite end portions of said attachment plate.

7. The nail gun attachment of claim 6, wherein said side walls of said adaptor form a channel.

8. The nail gun attachment of claim 7, wherein said adaptor is removably attached to said nail gun by screws being tightened over said end portions of said attachment plate within said grooves.

9. The nail attachment of claim 8, further comprising a plurality of adaptors, each having a differing distance between said grooves of said attachment plate, a selected one of said adaptors corresponding to the spacing between said cap screws on a particular model of nail gun.

10. The nail gun attachment of claim 9, wherein said lifting blade is a steel plate, said lower curved portion being in the shape of a partial "C", said lifting blade being about 2¾ inches wide at the top portion and the front end being about ⅜ of an inch wide.

11. The nail gun attachment of claim 10 wherein said brackets are about ¾ of an inch wide and about 1 inch in height, said aligned bores being about ¼ of an inch wide.

12. The nail gun attachment of claim 11, wherein said attachment plate is about 2½ inches wide and 1¼ inch deep, and said formed channel is about 1 inch long, 1 inch wide, and ¾ inch deep.

13. The nail gun attachment of claim 10, wherein said lifting blade is about 1⅙ inch in thickness.

14. The nail gun attachment of claim 13, further comprising a carbide strips at least one of the front and rear surfaces of said lifting blade.

15. A nail gun attachment for installation of roof shingles, comprising:

a lifting blade having rear mounted brackets, said lifting blade having a forward curved lower portion, a center portion and a planar top portion forming a front face, said lower portion curving downward and forward of said center portion, said lifting blade having a rear face corresponding with said front face, the forward curved lower portion of said blade having a chisel-like lower chamfered front end forming a rounded point for insertion under an adjacent shingle, said rear mounted brackets being mounted on said center portion, said rear mounted brackets being vertically oriented, parallel opposed spaced flats;

an adaptor having a generally horizontal, rectangular attachment plate having a front portion and a rear portion and having a channel portion depending from said front portion, said channel portion having a front wall and opposing side walls, said opposing side walls defining aligned bores, said adaptor attachment plate defining two spaced grooves extending forward from the rear portion thereof, said grooves corresponding with spaced front cap screw connecting the adapter attachment plate to the body of a nail driver, said opposing side walls of said depending channel portion defining aligned bores;

each said rear mounted brackets defining two vertically spaced, mutually aligned bores whereby said mounted brackets and, thus, said attachment may be mounted at one of two selected heights by aligning a corresponding selected bore with said bore within said vertical portion of said adaptor;

a spring detent pin extending through said aligned bores in said brackets and said aligned bores in said adaptor to removably retain said brackets over said adaptor;

said adaptor being removably mounted on said nail gun by means of said cap screws being tightened over said horizontal attachment plate within said spaced grooves, said cap screws holding the nail driver attachment plate to the nail driver body.

16. The attachment of claim 15, further comprising a plurality of adaptors, each having a differing distance between said spaced grooves of said horizontal attachment plate, a selected one of said adaptors corresponding to the spacing between said cap screws on a particular model of a nail gun.

* * * * *